US005632120A

United States Patent [19]

Shigematsu et al.

[11] Patent Number: 5,632,120

[45] Date of Patent: May 27, 1997

[54] POWERED VEHICLE DOOR CLOSING SYSTEM

[75] Inventors: Kouichi Shigematsu, Yokohama; Osamu Kawanobe, Isehara; Jun Yamagishi, Yokohama, all of Japan

[73] Assignee: Ohi Seisakusho Co., Ltd., Yokohama, Japan

[21] Appl. No.: 570,553

[22] Filed: Dec. 11, 1995

[30] Foreign Application Priority Data

Dec. 12, 1994 [JP] Japan ..... 06-307637

[51] Int. Cl.[6] ..... E05B 65/08; E05F 15/00

[52] U.S. Cl. ..... 49/449; 49/280; 49/360; 292/DIG. 23

[58] Field of Search ..... 49/449, 280, 360, 49/394, 28; 292/DIG. 23, 216, 341.16

[56] References Cited

U.S. PATENT DOCUMENTS

| | | | |
|---|---|---|---|
| 4,762,348 | 8/1988 | Matsumoto | 292/201 |
| 4,984,385 | 1/1991 | DeLand | 49/280 |
| 5,083,397 | 1/1992 | Koura | 49/280 X |
| 5,155,937 | 10/1992 | Yamagishi et al. | 49/280 |
| 5,189,839 | 3/1993 | DeLand et al. | 49/360 |
| 5,203,112 | 4/1993 | Yamagishi et al. | 49/280 |

FOREIGN PATENT DOCUMENTS

| | | |
|---|---|---|
| 4105684 | 9/1991 | Germany . |
| 4038241 | 10/1992 | Germany . |
| 4222365 | 1/1994 | Germany . |
| 19526227 | 2/1996 | Germany . |
| 3636828 | 2/1996 | Germany . |
| 1-105886 | 4/1989 | Japan . |

*Primary Examiner*—Philip C. Kannan
*Attorney, Agent, or Firm*—Foley & Lardner

[57] ABSTRACT

A powered vehicle door closing system for producing an auto-closing action to automatically move a latch member from a half-latched position to a fully-latched position, comprises a reversible motor mechanically linked through a linkage to the latch member for powering a final, low-displacement/high-force movement of a vehicle door, a half-latch detection switch such as a limit switch, and a controller for controlling the motor. The controller comprises a full-latch detection section for detecting the fully-latched position of the latch member and a stand-by position detection section for detecting the stand-by position of the linkage. To detect the fully-latched position and the stand-by position, the full-latch detection section and the stand-by position detection section respectively utilize changes in load imparted to the motor.

8 Claims, 13 Drawing Sheets

POWERED VEHICLE DOOR CLOSING SYSTEM

BACKGROUND OF THE INVENTION

1. Field of the Invention

The present invention relates to a powered vehicle door closing system and specifically to a powered vehicle door closing system suitable for an automotive vehicle such as a van with a sliding door moveable between open and closed positions relative to a vehicle body opening, and more specifically to a system which is capable of forcibly and automatically moving a latch member employed in a lock unit from a half-latched position (a nearly-closed position of the sliding door) to a fully-latched position (a fully-closed position of the sliding door) by powering the final, low-displacement/high-force movement of the sliding door.

2. Description of the Prior Art

Recently, there have been proposed and developed various powered vehicle door closing systems which can automatically move a latch member from a half-latched position to a fully-latched position. One such powered vehicle door closing system has been disclosed in Japanese Patent Provisional Publication (Tokkai Heisei) No. 1-105886. The powered door closing system disclosed in the Japanese Patent Provisional Publication No. 1-105886 is applied to a door lock for an automobile sliding door. The prior art door closing system has three switches, namely a first switch for detection of a half-latched state of the latch member, a second switch for detection of a fully-latched state of the latch member, and a third member for detection of a stand-by position of a moveable drive lever (a portion of a force-transmitting linkage) by way of which the latch member can be shifted from the half-latched position to the fully-latched position. The first switch consists of a pair of electrical contacts, one being a stationary electrical contact provided in the vehicle body and the other being a spring-loaded, plunger-type electrical contact provided onto the door for contact with the stationary contact upon shift to the half-latched position of the latch member via the manual door operation. The first switch is responsive to the movement of the sliding door in such a manner as to rotate the drive lever away from its stand-by position by way of normal rotation (positive rotation) of a drive motor such as a reversible electric motor when the sliding door reaches the half-latched position of the latch member, and as a result the latch member is forcibly moved to its fully-latched position. The second switch is responsive to the movement of the latch member in such a manner as to rotate the drive lever toward the stand-by position by way of reverse-rotation (negative rotation) of the drive motor when the latch member reaches the fully-latched position. The third switch is responsive to the movement of the drive lever in such a manner as to stop the drive motor and consequently to maintain the drive lever at the stand-by position immediately when the drive lever reaches the stand-by position. Each of the second and third switches consists of an ordinary limit switch which is so designed to cut off power automatically at or near the limit of travel of a moving object controlled by electrical means. The conventional system requires an accurate installation of the first, second, and third switches, since respective spring-loaded switching contacts or points of the second and third switches are mechanically operated and additionally the stationary electrical contact (included in the first switch) is provided in the vehicle body, while the other plunger-type electrical contact is provided onto the door for contact with the stationary contact. When installing the three switches on the vehicle, the conventional system requires a complicated wiring harness. This results in an increased assembling time of the respective switches onto the vehicle. Due to a complicated, costly structure of the conventional system, total manufacturing costs of the automotive vehicle with an auto door closing system is increased. Owing to an inherent switching characteristic of the limit switch with the spring-loaded mechanical contact, there is a possibility that a switched-ON operation of the limit switch cannot be completed, particularly during manual quick door closing operation with great momentum. There is a possibility of malfunction of the system.

SUMMARY OF THE INVENTION

Accordingly, it is an object of the invention to provide an improved powered vehicle door closing system which avoids the foregoing disadvantages of the prior art. That is, an object of the invention is to provide a simple, small-sized, and inexpensive powered vehicle door closing system.

It is another object of the invention to provide an improved powered vehicle door closing system which can detect that a latch member reaches its fully-latched position, and that a force-transmitting linkage, which is mechanically linked to the latch member for transmission of driving force produced by rotation of a geared motor, reaches its stand-by position (a neutral position).

In order to accomplish the aforementioned and other objects of the invention, a powered vehicle door closing system for producing an auto-closing action to automatically move a latch member from a half-latched position to a fully-latched position, the system comprises a reversible motor mechanically linked through a linkage to the latch member for powering a final, low-displacement/high-force movement of a vehicle door, first detection means for detecting that the latch member reaches the half-latched position to generate a first signal indicating that the half-latched position is reached, second detection means for detecting that the latch member reaches the fully-latched position during normal rotation of the motor to generate a second signal indicating that the fully-latched position is reached, third detection means for detecting that the linkage returns to its stand-by position during reverse rotation of the motor to generate a third signal indicating that the stand-by position is recovered, control means responsive to the first signal for moving the latch member toward the fully-latched position by the normal rotation, and responsive to the second signal for moving the linkage toward the stand-by position by the reverse rotation, and responsive to the third signal for de-energizing the motor, first prevention means for preventing the normal rotation when the fully-latched position is reached, and second prevention means for preventing the reverse rotation when the stand-by position is reached, wherein the second detection means includes a first load detection means for detecting changes in load imparted to the motor when the normal rotation is prevented by the first prevention means, and the third detection means includes a second load detection means for detecting changes in load imparted to the motor when the reverse rotation is prevented by the second prevention means.

The first load detection means may comprise a first current detection means for detecting changes in a drive current applied to the motor during the normal rotation, and the second load detection means may comprise a second current detection means for detecting changes in a drive current applied to the motor during the reverse rotation. The first current detection means generates the second signal when the drive current exceeds a first predetermined threshold during the normal rotation, and the second current detection means generates the third signal when the drive current exceeds a second predetermined threshold during the reverse rotation, and the second predetermined threshold is set at a lower value than the first predetermined threshold. It is preferable that the first current detection means generates the second signal when the drive current exceeds the first predetermined threshold for a predetermined period of time during the normal rotation, and the second current detection means generates the third signal when the drive current exceeds the second predetermined threshold for a predetermined period of time during the reverse rotation.

The system may further comprise means for moving the linkage to an additional stand-by position offset from the stand-by position by a predetermined short distance by the normal rotation of the motor, when the second current detection means generates the third signal. It is preferable to provide means for moving the linkage from the additional stand-by position to the stand-by position, when the first detection means generates the first signal. Actually, the means for moving the linkage to the additional stand-by position, moves the linkage to the additional stand-by position by driving the motor in a direction of the normal rotation for a setting time based on a supply voltage applied to the motor. Preferably, the setting time is set to be hyperbolically reduced in accordance with an increase in the supply voltage.

DESCRIPTION OF THE PREFERRED EMBODIMENTS

First embodiment

Figure 1:
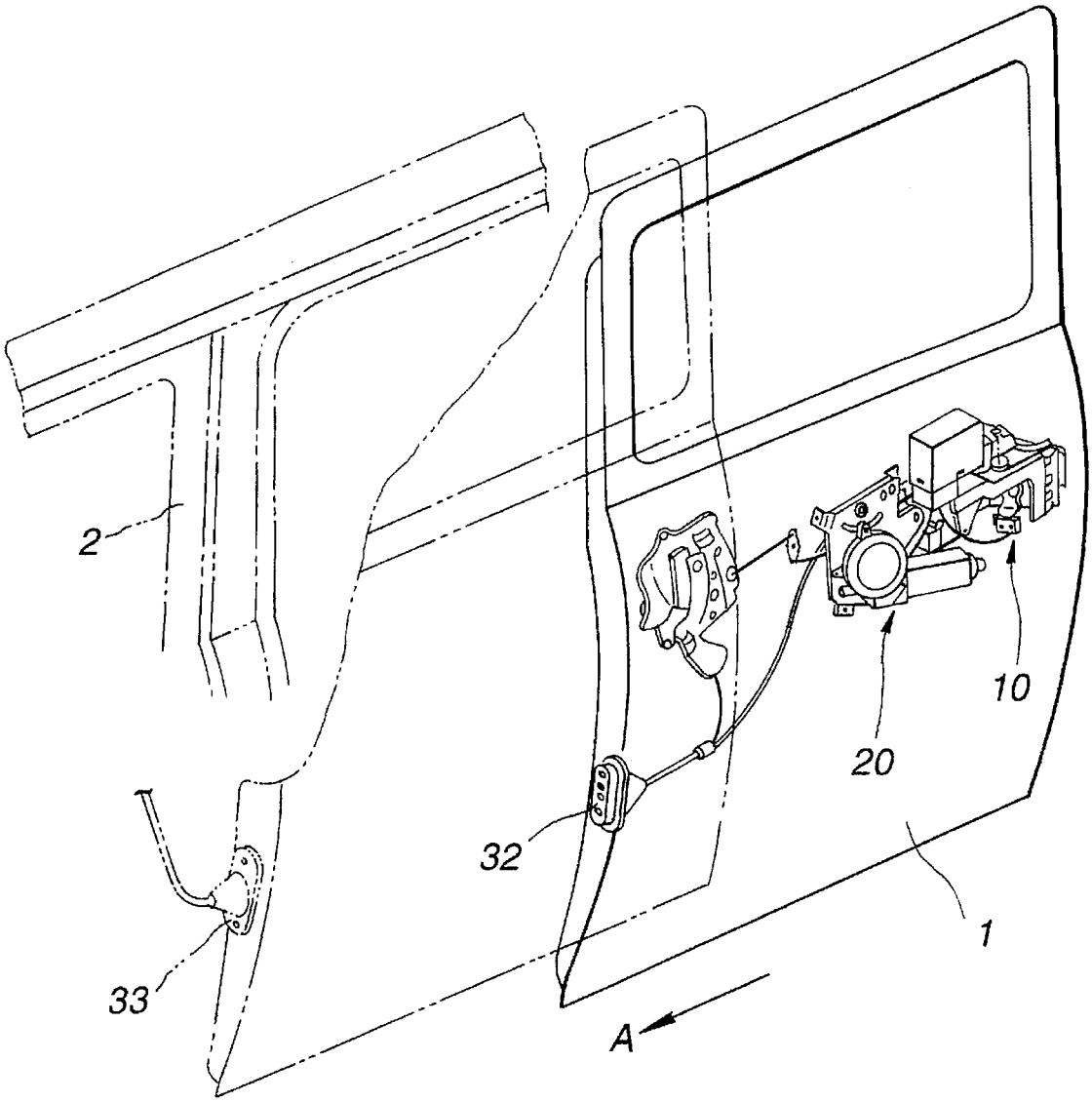
FIG. 1 is a perspective view illustrating an automobile sliding door employing a powered vehicle door closing system according to the invention.
Figure 2:
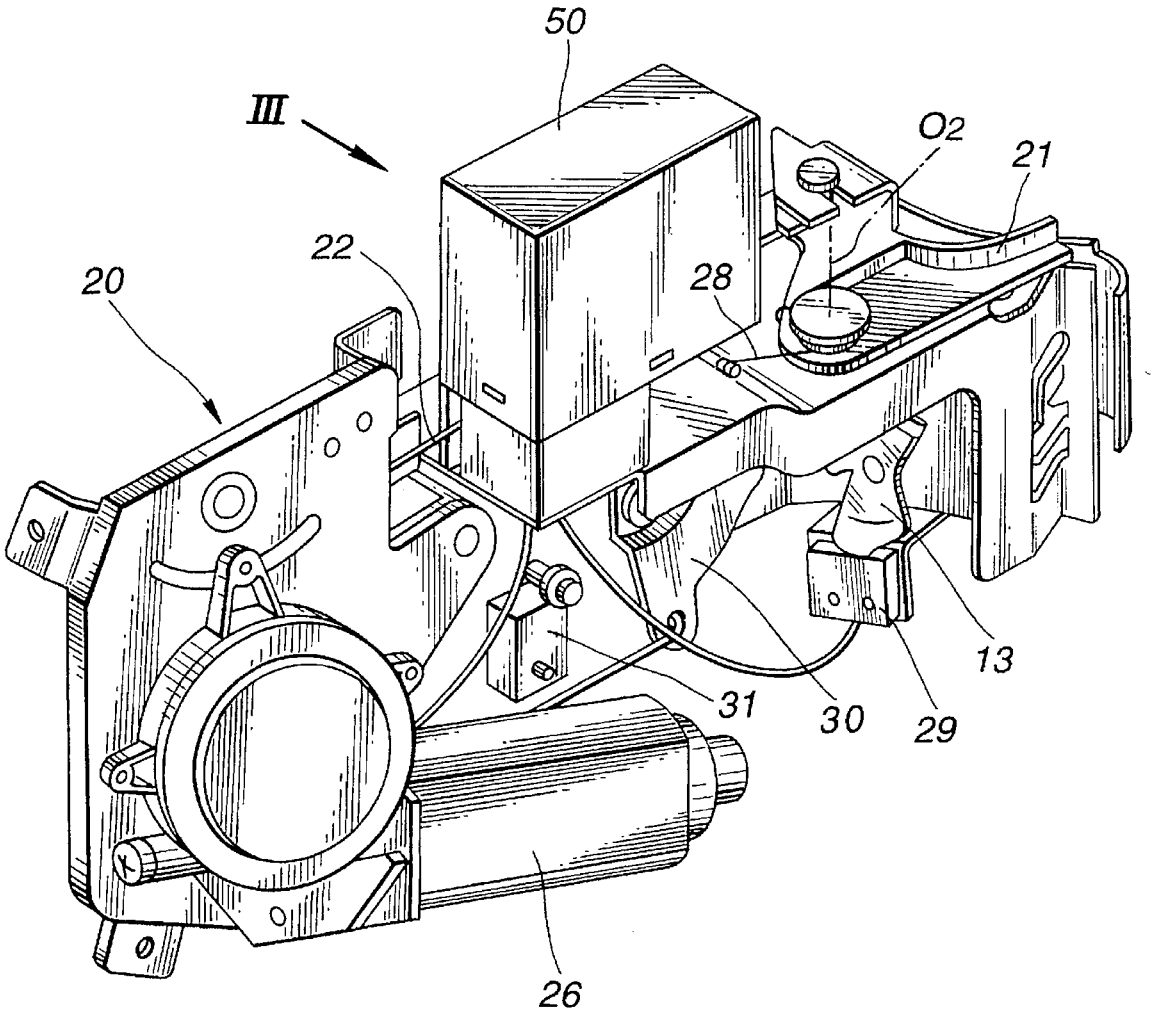
FIG. 2 is a perspective view illustrating a first embodiment of the powered vehicle door closing system made according to the invention.
Figure 3:
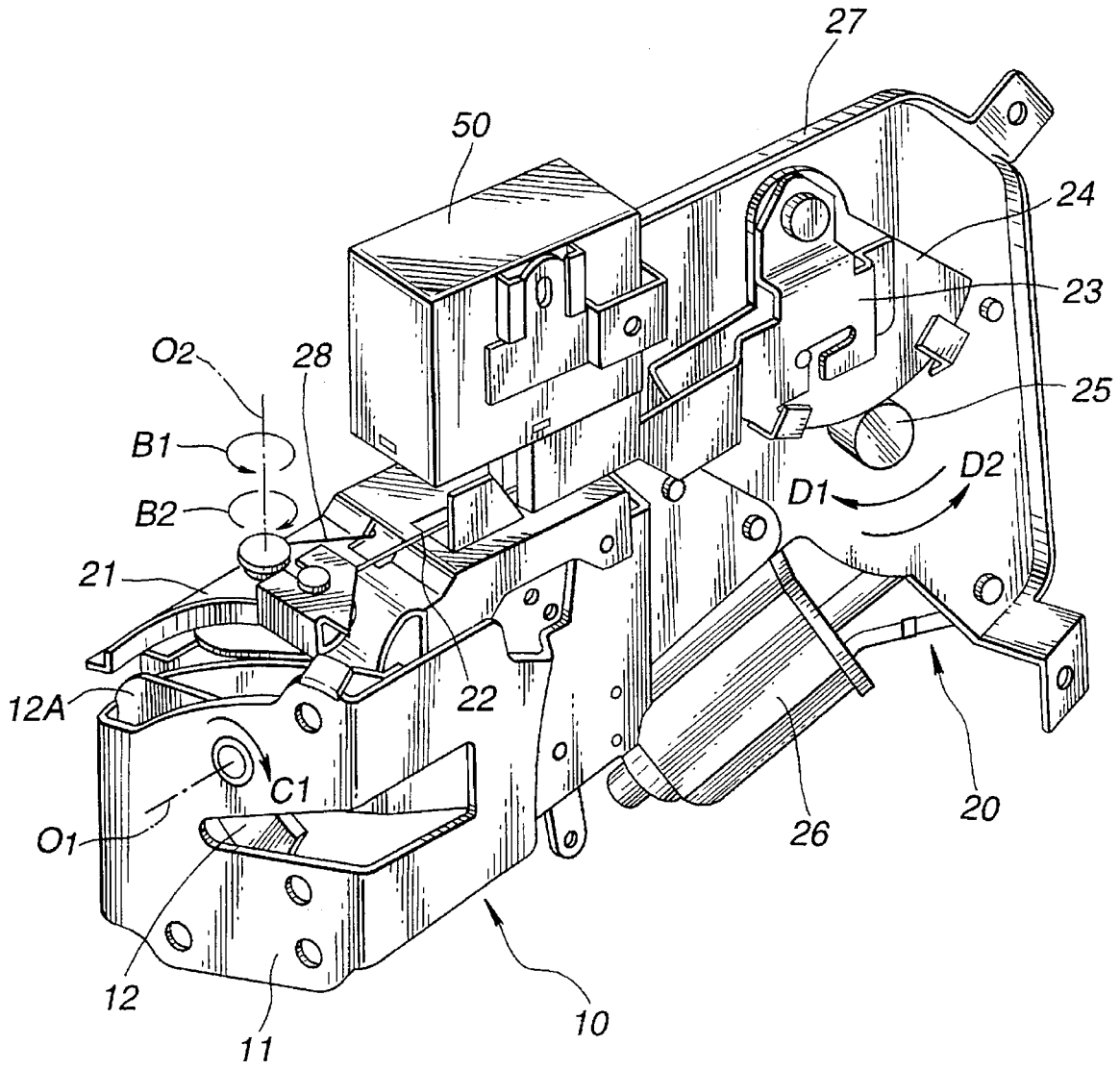
FIG. 3 is a perspective view taken in the direction of the arrow III of FIG. 2.

Referring now to the drawings, particularly to FIGS. 1 to 3, the powered vehicle door closing system of the invention is exemplified in case of a left-hand side sliding door 1 of an automotive vehicle. As seen in FIG. 1, the powered vehicle door closing system of the invention includes a door lock device 10 and a door closing device 20. As seen in FIGS. 2 and 3, the latter is often connected integrally to the door lock device 10 as a unit. As clearly seen in FIG. 3, a latch member 12 is rotatably supported on a base 11 of the door lock device 10 so that the latch member 12 is rotatable about the axial line O1 and engageable with a stationary striker pin (not shown) attached to the vehicle body 2. When the sliding door 1 is moved in the door closing direction as indicated by the arrow A of FIG. 1 and then the latch member 12 reaches its fully-latched position, in which the striker pin and the latch member 12 are completely engaged to each other, a locking plate (not shown) completely locks the latch member 12 at the fully-latched position in a conventional manner, with the result that the sliding door 1 is held at the fully-closed position. As is generally known, the locking plate is mechanically linked to a locking-plate release lever (not shown), by way of which the locking state of the latch member 12 can be released or unlocked. The door closing device 20 is equipped with a close lever 21 which is rotatable about the axial line O2. When the close lever 21 is rotated in the counterclockwise direction indicated by the arrow B1 (viewing FIG. 3) from the stand-by position (the neutral position as indicated in FIG. 3), the close lever 21 is brought into contact with the projected portion 12A of the latch member 12. With further counterclockwise rotation of the close lever 21, the latch member 12 is rotated in the direction indicated by the arrow C1. As a result of this, the latch member 12 reaches the half-latched position at which the latch member 12 begins to engage with the striker pin, and further urged to the fully-latched position at which the latch member 12 fully engages with the striker pin. The close lever 21 is mechanically linked through an intermediate linkage, namely a force-transmitting cable 22, a cable joint 23, a sector gear 24 (an output gear) and a motor-driven pinion gear 25, to a reversible geared motor 26. Reference numeral 27 denotes a bracket provided for mounting the door closing device 20 onto the door panel. The close lever 21 rotates in the direction indicated by the arrow B1 through the cable 22 by way of rotation of the pinion gear 25 in the direction indicated by the arrow D1 owing to normal-rotation of the motor 26 in the normal-rotation direction. Thereafter, when the motor 26 is driven in the reverse-rotation direction, and thus the pinion gear 25 is rotated in the direction indicated by the arrow D2, the close lever 21 rotates in the direction indicated by the arrow B2 by the aid of the bias of a return spring 28 and returns to the stand-by position (the neutral position). An open lever 13 mechanically linked to the latch member 12 and a half-latch detection switch 29 are provided for detecting whether or not the latch member 12 reaches the half-latched position. That is, the half-latch detection switch 29 is switched ON by the open lever 13, when the latch member 12 reaches the half-latched position. In the shown embodiment, the half-latch detection switch 29 consists of a conventional normally-open type limit switch or micro-switch having a spring-loaded plunger-type mechanical contact for a desired switching action. In more detail, when the latch member 12 is kept at the half-latched position, the cammed surface of the open lever 13 continues to push the mechanical contact of the detection switch 29, and as a result the mechanical contact is maintained at its retracted position, thus primarily switching the detection switch 29 ON. Owing to the cammed profile of the open lever 13, the mechanical contact of the detection switch 29 is shifted from the retracted position to the extended position and thus the detection switch 29 is switched OFF again, when the latch member 12 moves apart from the half-latched position in the rotational direction C1 toward the fully-latched position. As soon as the latch member 12 reaches the fully-latched position, the mechanical contact is maintained again at its retracted position and thus the detection switch 29 is secondarily switched ON. The secondarily switched-ON operation of the detection switch 29 can be utilized to detect whether or not the latch member 12 is maintained at the fully-latched position. When quickly closing the sliding door 1 with great momentum during manual door operation, the cammed surface of the open lever 13 will push the mechanical contact of the detection switch 29 twice for an excessively short time interval. Due to an inherent switching characteristic of the detection switch 29 with the spring-loaded mechanical contact, there is a possibility that the secondarily switched-ON operation of the switch 29 cannot be completed, during quick door closing. For the reasons set forth above, the system of the embodiment utilizes variations in load applied to the motor 26 to precisely detect as to whether or not the latch member 12 is kept at the fully-latched position, as explained later. Once the latch member 12 has been shifted to the fully-latched position, the rotational movement of the latch member 12 is prevented by a stopper (not shown). With the latch member 12 urged to and maintained at the fully-latched position, the normal-rotation of the motor 26 is restricted and stopped through the above-noted intermediate linkage. On the other hand, when the close lever 21 rotates in the direction indicated by the arrow B2 and then reaches the stand-by position, the sector gear 24 abuts the bracket 27 and thus the reverse-rotation of the motor 26 is prevented.

The door closing device 20 is controlled by a controller 50. When the half-latch detection switch 29 detects that the latch member 12 reaches the half-latched position, the close lever 21 starts to rotate in the direction indicated by the arrow B1 by way of normal-rotation of the motor 26 and then the latch member 12 is forcibly rotated to the fully-latched position in the direction indicated by the arrow C1. The above-mentioned forcible rotational motion of the latch member 12 to the fully-latched position will be hereinafter referred to as an "auto door-close operation" and abbreviated to a "door-close operation". When a full-latch detection section 57; as explained later, detects that the latch member 12 reaches the fully-latched position, the motor 26 is rotated in the direction of reverse-rotation and thus the close lever 21 is rotated in the direction indicated by the arrow B2 by way of the bias of the return spring 28 and then reaches the stand-by position. When a stand-by position detection section 58, as explained later, detects that the close lever 21 reaches the stand-by position, the motor 26 is stopped. In this manner, a series of final closing movements of the door terminates. The above-mentioned returning motion of the close lever 21 to the stand-by position (the neutral position) will be hereinafter referred to as a "return-to-neutral operation". Returning to FIG. 1, the door closing device 20 is connectable to a car battery 3 (See FIG. 4) through a pair of electric-power feeding portions 32 and 33. As seen in FIG. 1, the moveable power-feeding portion 32 is attached to the sliding door 1, while the stationary power-feeding portion 33 is attached to the vehicle body 2. The moveable power-feeding portion 32 is brought into electric-contact with the stationary power-feeding portion 33, when the body opening becomes less than or equal to a predetermined opening degree, that is when the sliding door 1 reaches a predetermined partly-opened position via which partly-opened position the latch member 12 reaches the half-latched position during door closing. The feeding portions 32 and 33 are so designed that the moveable power-feeding portion 32 comes into electric-contact with the stationary power-feeding portion 33 before the latch member 12 rotates to the half-latched position during the manual door closing operation. With the two power-feeding portions 32 and 33 in contact, a power-supply circuit for the controller 50 is established. For example, in a conventional manner, the stationary power-feeding portion 33 may consist of a plurality of stationary electrical contacts, whereas the moveable power-feeding portion 32 may consist of a plurality of spring-loaded, plunger-type electrical contacts. To enhance safety, if the outside handle of the sliding door 1 is manually operated by the operator during operation of the door closing device or during activation of the drive motor, the controller 50 operates to stop the final closing action of the door closing device 20 and additionally the state of the device 20 is shifted from the auto door-close state to the stand-by state in which the close lever 21 is maintained at the stand-by position. The outside-handle operation is detected by a handle switch 31 such as a limit switch or a micro-switch whose contact is mechanically linked through a handle lever 30 to the outside lever. Thus, when the operator pulls the outside handle of the door 1 for the purpose of opening the door, the lock is released manually and the door can be opened freely.

Figure 4:
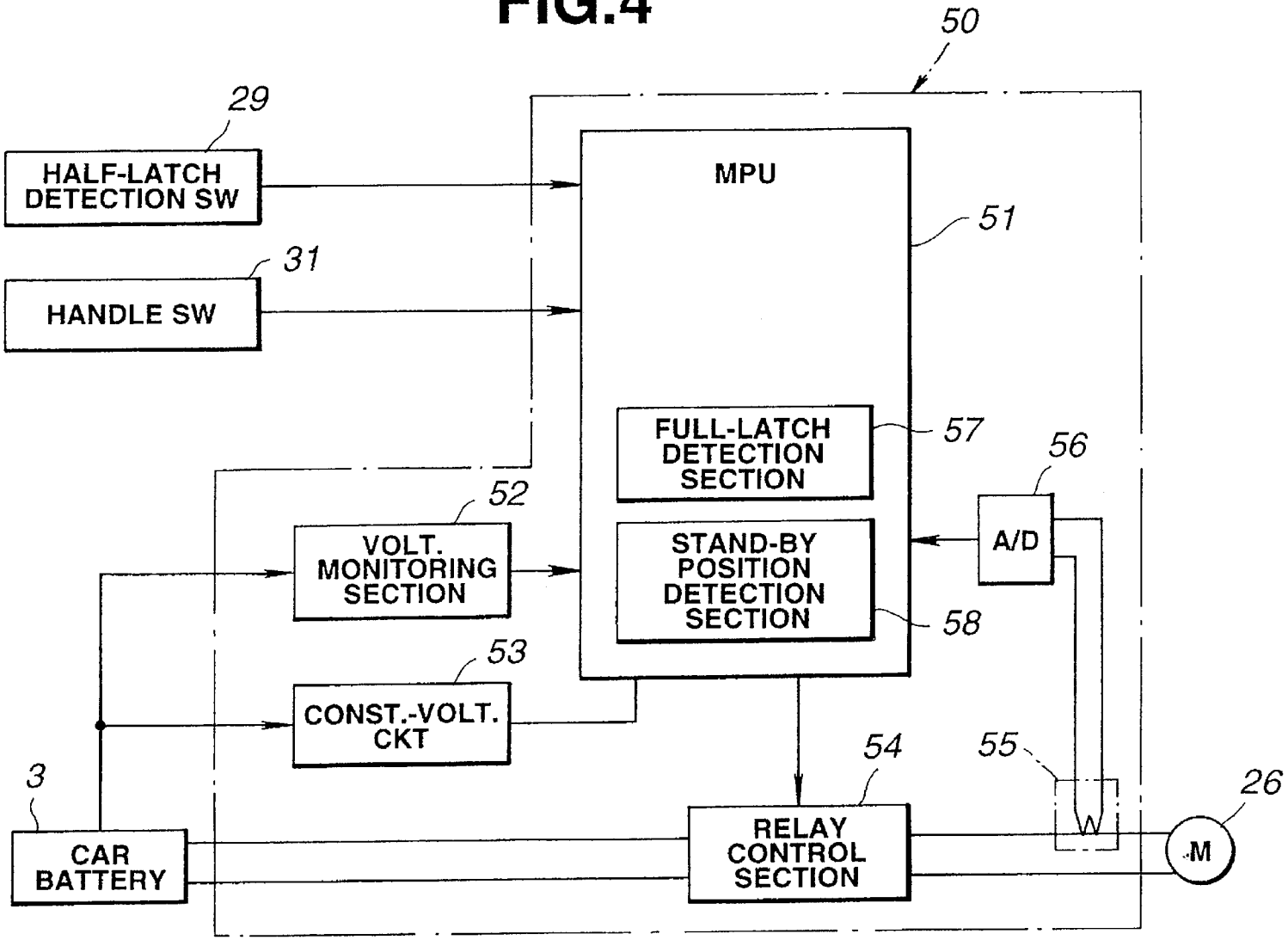
FIG. 4 is a block diagram illustrating a control system for the powered vehicle door closing system of the first embodiment.

Referring now to FIG. 4, there is shown a block diagram illustrating the controller 50. The controller 50 includes a central processing unit (a micro processor abbreviated to "MPU") 51, a voltage monitoring section 52 provided for monitoring a voltage level of the car battery 3, a constant-voltage circuit 53, a relay control section 54 provided in a motor drive circuit between the battery 3 and the motor 26, a current detection section 55 provided for detecting a drive current for the motor 26, and an analog-to-digital converter (A/D converter) 56 provided for converting an analog signal (the current signal from the detection section 55) into a digital signal. The micro processor 51 includes the full-latch detection section 57 and the stand-by position detection section 58. As explained later, the full-latch detection section 57 and the stand-by position detection section 58 are both responsive to signals from the half-latch detection switch 29, from the handle switch 31, and from the A/D converter 56, in order to detect that the latch member 12 has rotated to the fully-latched position and to detect that the close lever 21 has rotated to the stand-by position, respectively. Additionally, the micro processor 51 controls a normal-rotation relay and a reverse-rotation relay both employed in the relay control section 54 in such a manner as to drive the drive motor 26 in the normal-rotation direction or in the reverse-rotation direction. In consideration of inherent switching characteristics of the detection switch 29 and the handle switch 31, it is desirable that a normal switching action of the respective switches 29 and 31 is confirmed by determining whether or not a switched-ON or switched-OFF state continues for a predetermined period of time or more.

Figure 8:
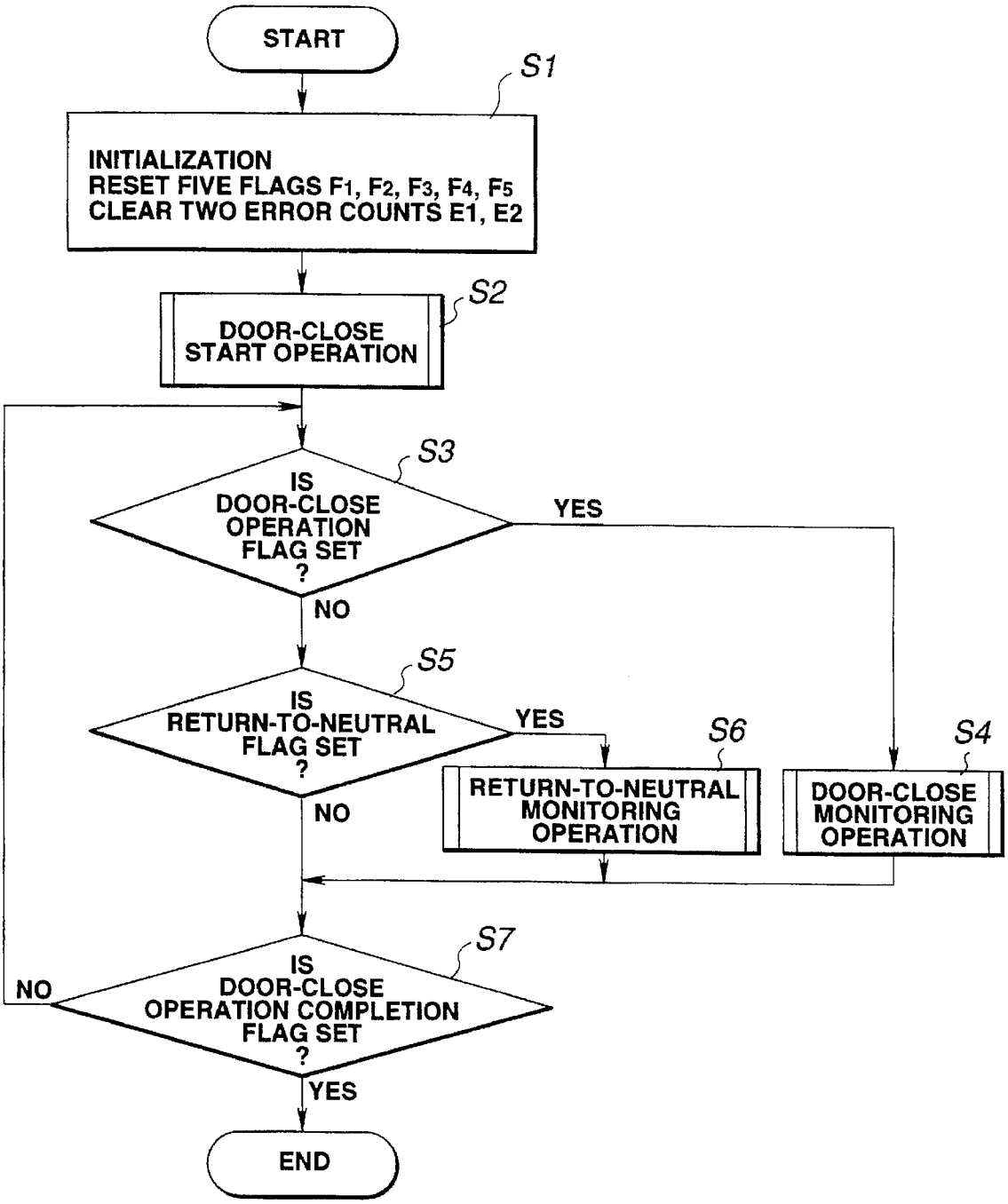
FIG. 8 is a flow chart illustrating a main routine executed the system of the first embodiment.

Referring to FIG. 8, there is shown a main program or a main routine executed by the controller 50. This main routine is executed as time-triggered interrupt routines to be triggered every predetermined sampling time intervals. The control procedure of the controller 50 will be hereinafter described in detail in accordance with the flow chart indicated in FIG. 8.

In step S1, initialization is executed so that five flags F1, F2, F3, F4 and F5, as described later, are reset, and two error counts E1 and E2 are cleared. Thereafter, the door-close start operation (corresponding to the sub-routine indicated in FIG. 9) is executed at step S2, and then step S3 enters.

In step S3, a test is made to determine whether or not the door-close operation flag F1 is set. The door-close operation flag=1 means that the door closing device 20 is energized and the door-close operation is executed currently. When the answer to step S3 is affirmative (YES), i.e., in case that the door-close operation flag F1 is set, step S4 proceeds in which the door-close monitoring operation (corresponding to the sub-routine indicated in FIG. 10) is executed. When the answer to step S3 is negative (NO), i.e., in case that the door-close operation flag F1 is reset, step S5 proceeds in which a test is made to determine whether or not the return-to-neutral flag F2 is set. The return-to-neutral flag=0 means that the return-to-neutral operation has already been completed. When the answer to step S5 is affirmative (YES), i.e., in case that the return-to-neutral flag F2 is set to "1", step S6 proceeds in which the return-to-neutral monitoring operation (corresponding to the sub-routine indicated in FIG. 11) is executed. When the answer to step S5 is negative (NO), i.e., in case that the return-to-neutral flag F2 is reset to "0", step S7 enters.

Figure 10:
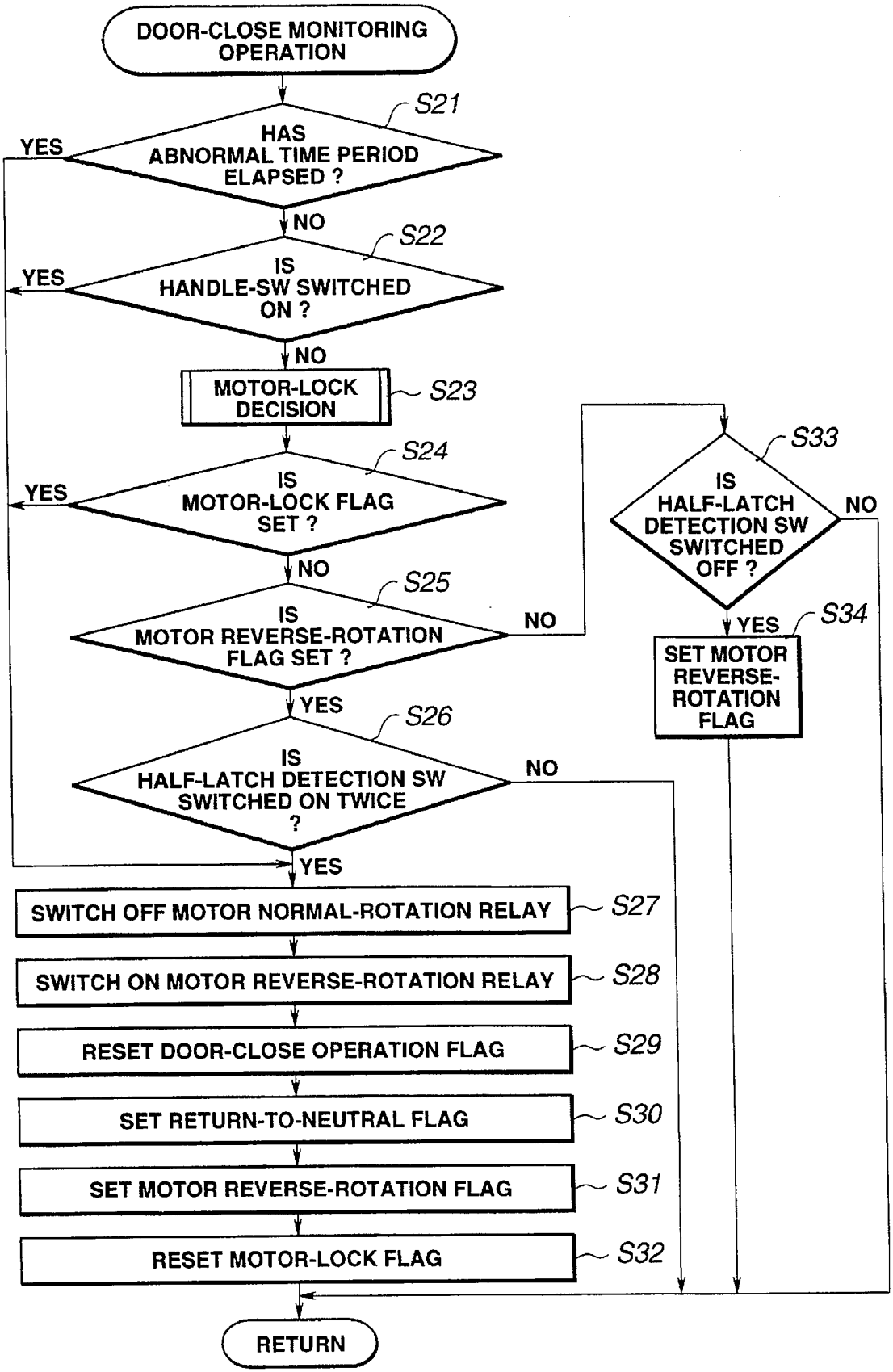
FIG. 10 is a flow chart explaining the door-close monitoring operation corresponding to step S4 of FIG. 8.
Figure 11:
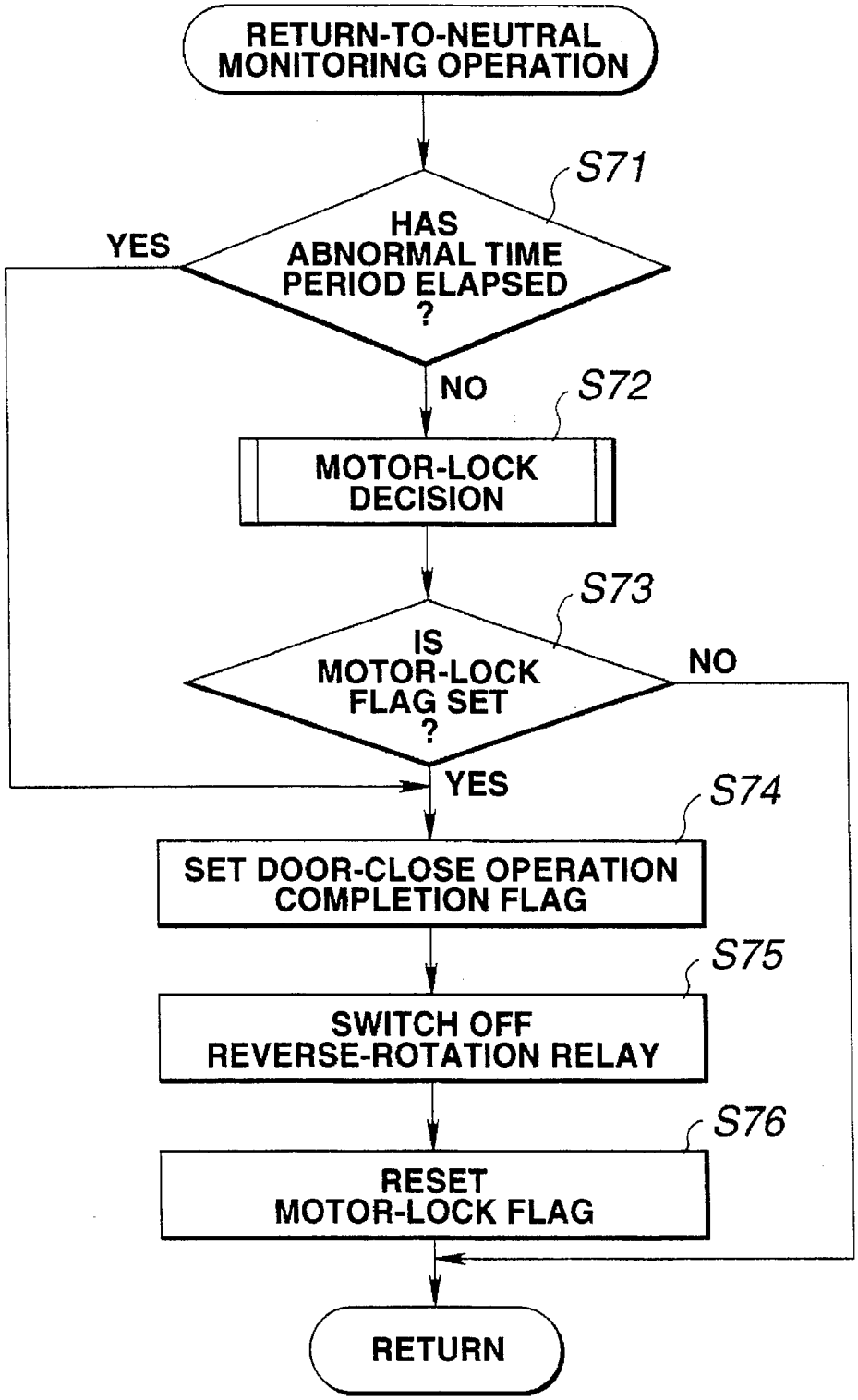
FIG. 11 is a flow chart explaining the return-to-neutral monitoring operation corresponding to step S6 of FIG. 8.

In conjunction with the respective of the door-close monitoring operation illustrated in FIG. 10 and the return-to-neutral monitoring operation illustrated in FIG. 11, the motor-lock decision operation (corresponding to the sub-routine indicated in FIG. 12) is executed. The motor-lock decision is made by means of the full-latch detection section 57 during the door-close monitoring operation. On the other hand, during the return-to-neutral operation or during the return-to-neutral monitoring operation, the motor-lock decision is made by means of the stand-by position detection section 58.

In step S7, a test is made to determine whether or not the door-close operation completion flag F3 is set. When the answer to step S7 is affirmative (YES), i.e., in case that the door-close operation completion flag is set, a series of auto door closing action of the door closing device 20 terminates. When the answer to step S7 is negative (NO), i.e., in case that the door-close operation completion flag F3 is reset, the procedure jumps to step S3.

Figure 9:
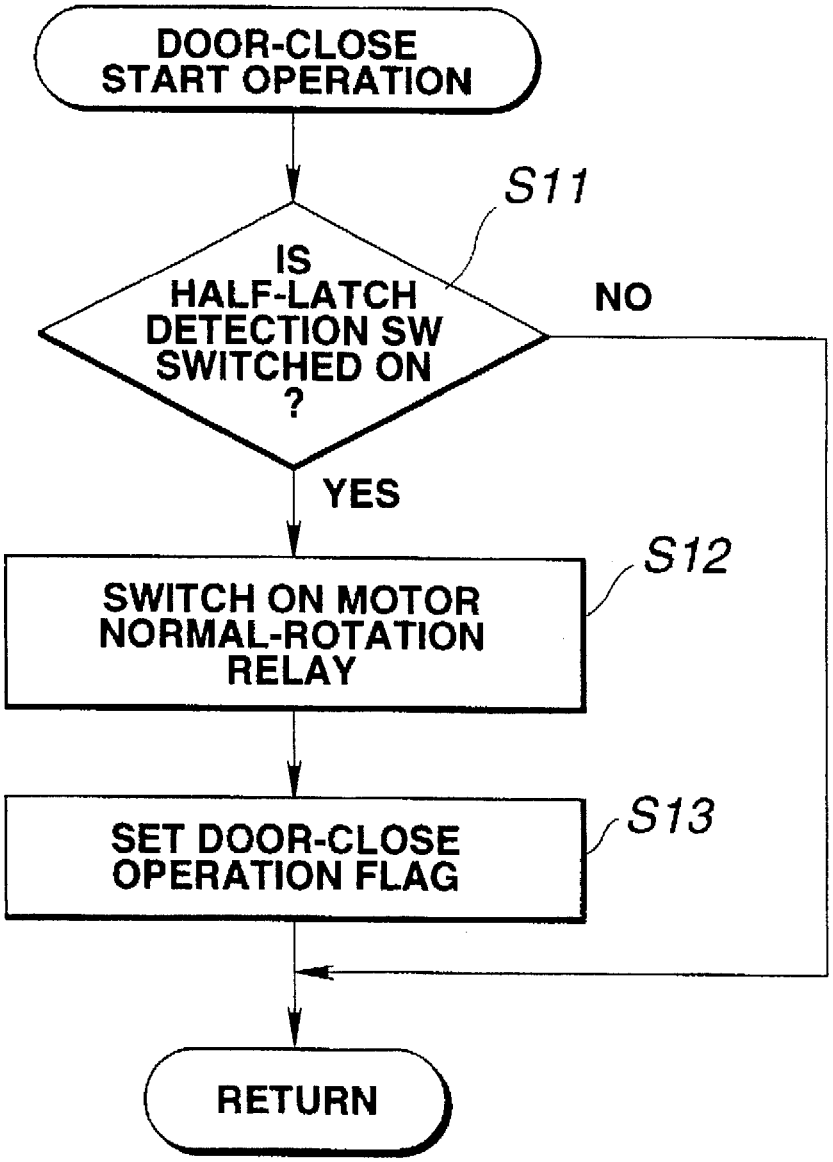
FIG. 9 is a flow chart explaining the door-close start operation corresponding to step S2 of FIG. 8.

The above-noted door-close operation is hereinbelow described in detail in accordance with the flow chart indicated in FIG. 9.

Firstly, in step S11, a test is made to determine whether the half-latch detection switch 29 is switched ON or OFF. Only when the answer to step S11 is affirmative (YES), that is, the half-latch detection switch 29 is switched ON, the procedure transfers to step S12.

In step S12, the normal-rotation relay employed in the relay control section 54 is switched ON.

In step S13, the door-close operation flag F1 is set. Through the flow from step S11 via step S12 to step S13, with the motor normal-rotation relay switched ON, the motor normal-rotation circuit is established to initiate normal-rotation of the motor 26, thus permitting the close lever 21 to rotate in the direction indicated by the arrow B1 (See FIG. 3).

In this manner, as soon as the door-close operation flag F1 is set, the sub-routine related to the door-close monitoring operation is executed in accordance with the flow chart indicated in FIG. 10.

Figure 12:
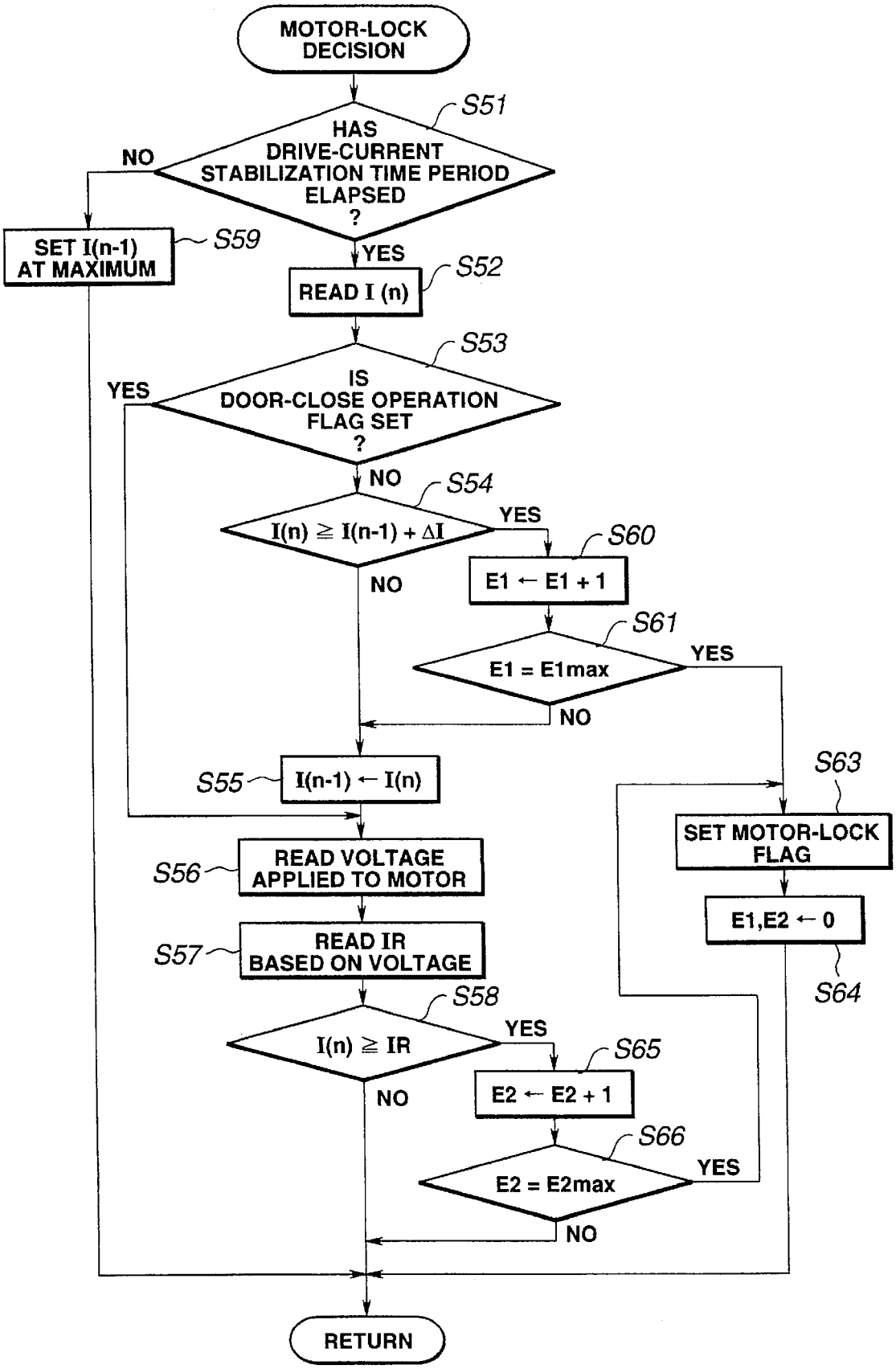
FIG. 12 is a flow chart explaining the motor-lock decision operation illustrated in step S23 of FIG. 10 and in step S72 of FIG. 11.

In step S21, a test is made to determine whether or not a predetermined abnormal time period has elapsed from the time when the motor normal-rotation relay is switched ON. As appreciated from steps S21, S22 and S23, on the assumption that the handle switch 31 is not yet switched ON within the predetermined abnormal time period, the procedure flows from step S21 via step S22 to step S23 at which the motor-lock decision operation is executed as shown in FIG. 12. When the answer to step S21 is affirmative (YES), the controller decides that abnormality in the door-close operation takes place, and then step S27 enters. Conversely, when the answer to step S21 is negative (NO), step S22 proceeds at which a test is made to determine whether the handle switch 31 is switched ON or OFF. When the answer to step S22 is affirmative (YES), i.e., when the handle switch 31 is switched ON, the controller decides that the sliding door 1 is in the door opening state, and then step S27 enters.

In step S27, the motor normal-rotation relay is switched OFF. Thereafter, the procedure flows through steps S28, S29, S30 and S31 to step S32.

In step S28, the reverse-rotation relay of the motor 26 is switched ON to initiate reverse-rotation of the motor 26.

In step S29, the door-close operation flag F1 is reset.

In step S30, the return-to-neural flag F2 is set.

In step S31, the motor reverse-rotation flag F5 is set.

In step S32, the motor-lock flag F4 is reset.

When the answer to step S22 is negative (NO), i.e., when the handle switch 31 is switched OFF, step S23 proceeds at which the motor-lock decision procedure is executed in accordance with the flow chart illustrated in FIG. 12.

In step S51, a test is made to determine whether or not a predetermined time period t0, required for stabilization of the drive current I of the motor 26, has elapsed from the time when the motor normal-rotation relay or the motor reverse-rotation relay has been switched ON. The predetermined time period t0 will be hereinafter referred to as a "drive-current stabilization time period t0". When the answer to step S51 is affirmative (YES), i.e., in case that the drive-current stabilization time period t0 has elapsed, step S52 proceeds in which the current value I(n) of the drive current of the motor 26 is read. Thereafter, step S53 enters. In contrast, when the answer to step S51 is negative (NO), i.e., in case that the drive-current stabilization time period to has not yet elapsed, step S59 proceeds in which the previous value I(n−1) of the motor drive-current is set at a predetermined maximum current.

In step S53, a test is made to determine whether or not the door-close operation flag is set. When the answer to step S53 is affirmative (YES), that is, when the door-close operation flag is set to "1", the procedure jumps to step S56. When the answer to step S53 is negative (NO), that is, when the door-close operation flag is reset to "0", step S54 proceeds in which the current value I(n) of the motor drive-current is compared with a comparison current represented by the formula $\{I(n-1)+\Delta I\}$, where I(n−1) denotes the previous value of the drive current, derived during the previous sampling, and $\Delta I$ denotes a predetermined positive rate-of-change threshold of the drive current. In step S54, in case that the current value I(n) is greater than or equal to the comparison current $\{I(n-1)+\Delta I\}$, the controller decides that the motor 26 is in an overload state. In this case, the procedure shifts from step S54 to step S60 in which a first error count E1 is incremented by "1". Thereafter, the procedure flows to step S61 in which a test is made to determine whether or not the first error count E1 reaches a predetermined upper limit E1max. In the event that the first error count E1 reaches the upper limit E1max, the controller decides that the latch member 12 is restricted or locked in the fully-latched position and also the rotational movement of the close lever 21 (in the direction indicated by the arrow B1) is prevented. Thereafter, the motor-lock flag is set in step S63, and then the first error count E1 is cleared at step S64. On the other hand, in the event that the current value I(n) is less than the comparison current $\{I(n-1)+\Delta I\}$, step S55 proceeds in which the previous value I(n−1) is updated by the current value I(n). In the event that the first error count E1 is less than the upper limit E1max, step S55 enters in which the current value I(n) of the drive current is stored as the previous value I(n−1) in a predetermined memory address in the memory employed in the central processing unit 51.

In the case that the motor-lock flag is set at step S63 of FIG. 12, the procedure indicated in FIG. 10 flows from step S24 via step S27 to step S32, so as to initiate the reverse-rotation of the motor 26. Thereafter, the previously-described return-to-neutral operation begins.

Hereinbelow described in detail the drive current I of the motor 26.

Figure 5:
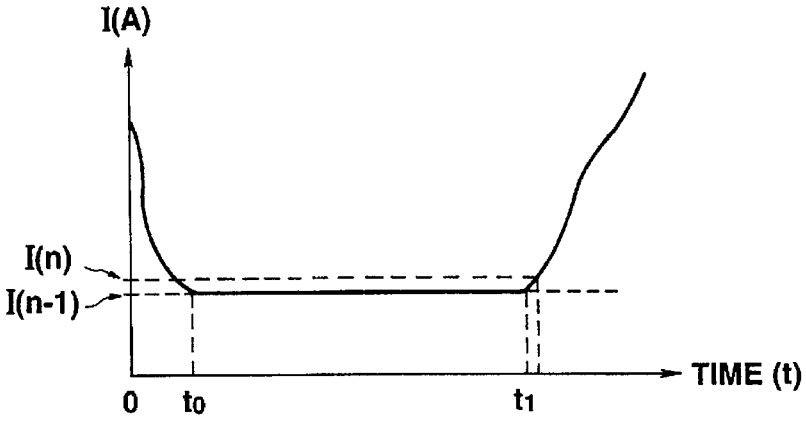
FIG. 5 is a time chart explaining a method for motor-lock decision depending on variations in a drive current of the motor shown in FIG. 1.
Figure 6:
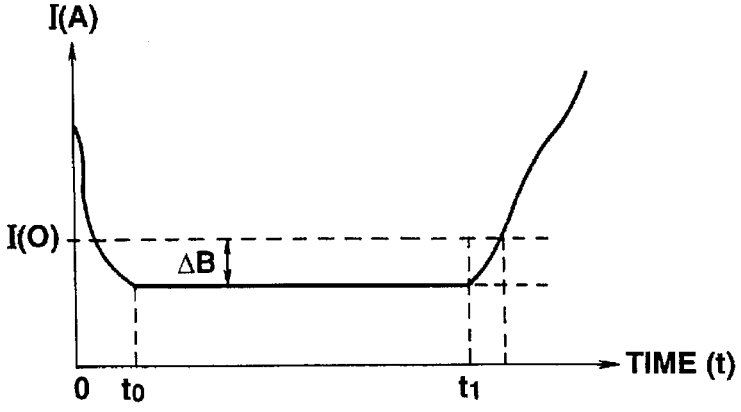
FIG. 6 is a time chart explaining another method for motor-lock decision depending on variations in a drive current of the motor.

As seen in the graph illustrated in FIG. 5, during activation of the motor 26, the motor drive-current I almost stabilizes from the time when the predetermined drive-current stabilization time period t0 has elapsed, up to the time t1 when the rotational movement of the motor 26 has been restricted. From just after the time t1, the drive current I rises rapidly. Thus, when the deviation between the current value I(n) and the previous value I(n−1) exceeds the predetermined threshold ΔI, it can be decided that the motor 26 is restricted. To avoid misjudgment owing to temporary rise in the motor load, and to precisely set the motor-lock flag F4, the controller decides that the motor 26 is restricted or locked when the particular condition defined by the inequality $\{I(n) \geqq I(n-1)+\Delta I\}$ is satisfied for a preset period of time, that is to say, when the error count E1 reaches the predetermined upper limit E1max. Alternatively, as appreciated from the graph illustrated in FIG. 6, a drive-current value I(O) measured during no-load running of the motor 26 may be compared with the actual drive current I measured during auto door-close operation, so as to decide as to whether the rotational movement of the motor 26 is restricted or locked. That is, the controller can decide as to whether or not the rotational movement of the motor 26 is restricted, by comparing the deviation between the drive-current value I(O) and the actual drive current I with a predetermined threshold value ΔB. In lieu thereof, in order to detect changes in load applied to the motor 26, a rate-of-change (a differential) of the drive current I with time or a change in rotational speed of the motor 26 may be utilized.

In addition to the above-mentioned procedure for setting the motor-lock flag, in the shown embodiment, fluctuations in voltage applied to the motor 26 through the relay control section 54 are further considered. To more precisely set the motor-lock flag F4, the controller utilizes comparison results between the actual drive current I and a motor-lock current IR based on the voltage actually applied to the motor. That is, for the purpose of more precise motor-lock decision, steps S56 to S58 and steps S65 and S66 are provided.

Returning to FIG. 12, in step S56, a value of the voltage signal from the voltage monitoring section 52 (See FIG. 4) is read.

Figure 7:
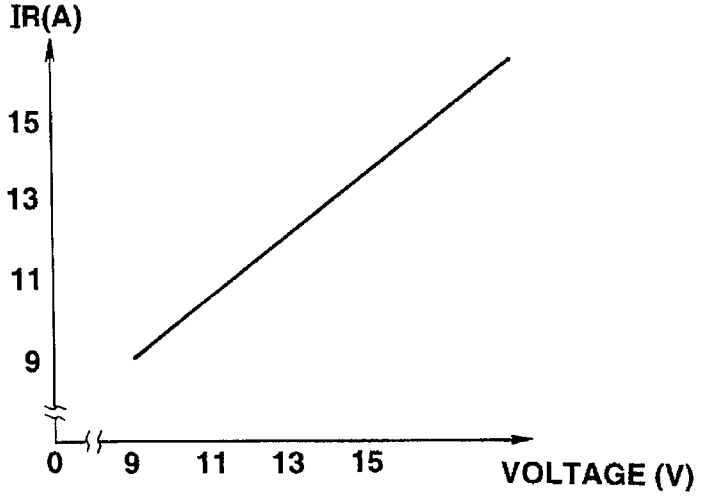
FIG. 7 is a graph illustrating the relationship between the power-source voltage and the motor-lock current.

In step S57, a motor-lock current IR is read on the basis of the voltage derived at step S56, in accordance with the correlation illustrated in FIG. 7 which is pre-stored in the form of data map in the memory of the MPU 51 in a conventional manner. As can be appreciated from the voltage versus motor-lock current characteristic shown in FIG. 7, the motor-lock current IR tends to increase essentially in proportion to an increase in the supply voltage.

In step S58, the motor-lock current IR is compared with the current value I(n) of the motor drive-current. When the current value I(n) is equal to or greater than the motor-lock current IR, step S65 proceeds in which a second error count E2 is incremented by "1". Thereafter, step S66 enters in which the second error count E2 is compared with a predetermined upper limit E2max in the same manner as step S61. In the shown embodiment, the upper limit E2max for the second error count E2 is set at the same value as the upper limit E1max for the first error count E1. When the second error count E2 reaches the upper limit E2max, the controller outputs a motor-lock decision instruction indicating that the motor is restricted or locked. In the presence of output of the motor-lock decision instruction, the motor-lock flag is set at step S63 and then the first and second error counts E1 and E2 are both cleared to "0" at step S64.

Returning to FIG. 10, at step S24, in case that the motor-lock flag is reset, step S25 enters in which a test is made to determine whether the motor reverse-rotation flag is set. When the answer to step S25 is negative (NO), that is, when the motor reverse-rotation flag is reset, step S33 proceeds in which a test is made to determine whether the half-latch detection switch 29 is switched OFF. When the answer to step S33 is affirmative, the motor reverse-rotation flag is set at step S34. As appreciated from the flow from step S25 via step S33 to step S34, the motor reverse-rotation flag can be set when the latch member 12 is rotating away from the half-latched position towards the fully-latched position. In this manner, after the motor reverse-rotation flag has been set, the procedure flows from step S25 to step S26 at which a test is made to determine whether or the half-latch detection switch 29 is switched ON twice. When the answer to step S26 is affirmative (YES), that is, when the half-latch detection switch 29 is switched ON once with the latch member 12 passing through the half-latched position and then the switch 29 is switched ON again with the latch member 12 maintained at the fully-latched position, the procedure flows from step S26 through steps S27, S28, S29, S30 and S31 to step S32, so as to initiate the reverse-rotation of the motor 26 and consequently to execute the return-to-neutral operation.

The return-to-neutral operation and the return-to-neutral monitoring operation are hereinbelow described in detail.

After the return-to-neutral flag and the motor reverse-rotation flag are both set, the return-to-neutral operation begins by driving the motor 26 in the reverse-rotation direction. With the return-to-neutral flag F2 set, as seen in the main routine shown in FIG. 8, the procedure transfers from step S5 to step S6, so as to simultaneously execute the return-to-neutral monitoring operation in accordance with the flow chart shown in FIG. 11.

Referring to FIG. 11, in step S71, a test is made to determine whether or not the above-noted predetermined abnormal time period has elapsed from the time when the motor reverse-rotation relay has been switched ON. The answer to step S71 is negative (NO), i.e., when the abnormal time period has not yet elapsed, step S72 proceeds in which the previously-noted motor-lock decision procedure is executed in accordance with the flow chart of FIG. 12. Conversely, when the answer to step S71 is affirmative (YES), i.e., in case that the predetermined abnormal time period has elapsed, the controller decides that abnormality in the door-close operation takes place, and then step S74 enters in which the door-close operation completion flag is set. Thereafter, the motor reverse-rotation relay is switched OFF at step S75, and then the motor-lock flag is reset at step S76.

During the motor-lock decision operation at step S72 of FIG. 11 (the return-to-neutral monitoring operation), changes or variations in the drive current I are monitored in the same manner as during the motor-lock decision operation at step S23 of FIG. 10 (the door-close monitoring operation). Based on changes (a steep current-rise) in the drive current I monitored, the controller outputs a decision instruction representing that the close lever 21 is rotated to the stand-by position and also the sector gear 24 abuts the inner wall of the bracket 27, and thus the reverse-rotation of the motor 26 is restricted or locked. In the presence of output of the decision instruction, the motor-lock flag is set. With the motor-lock flag set to "1", the procedure of FIG. 11 flows from step S73 through steps S74 and S75 to step S76.

Second embodiment

Figure 13:
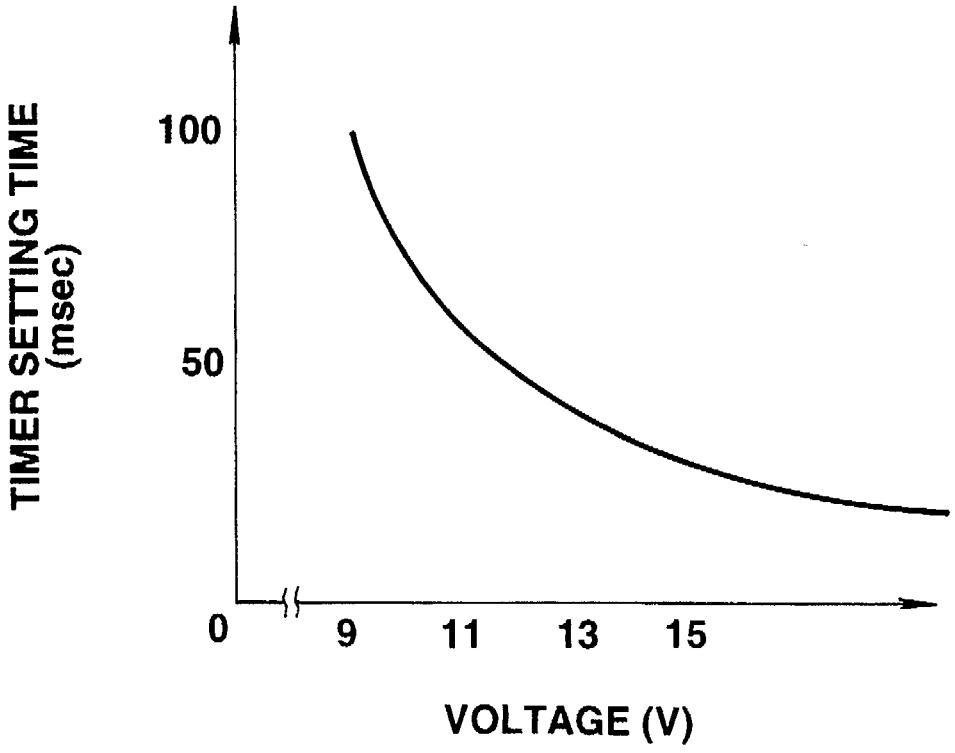
FIG. 13 is a graph illustrating a characteristic curve indicative of a supply-voltage versus setting time characteristic in the timer employed in the system of the second embodiment.
Figure 14:
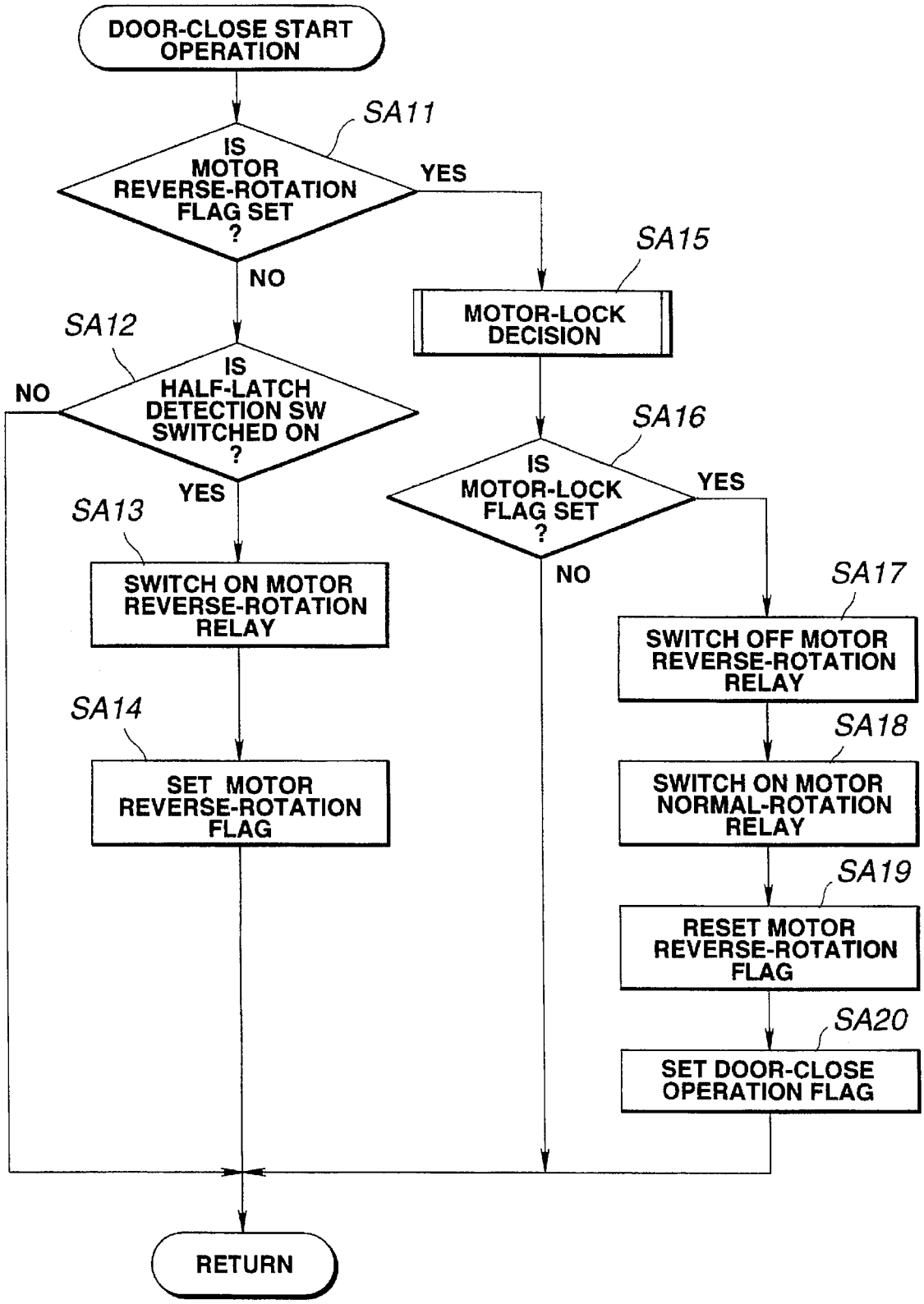
FIG. 14 is a flow chart explaining the auto door-close start operation of the system of the second embodiment.
Figure 15:
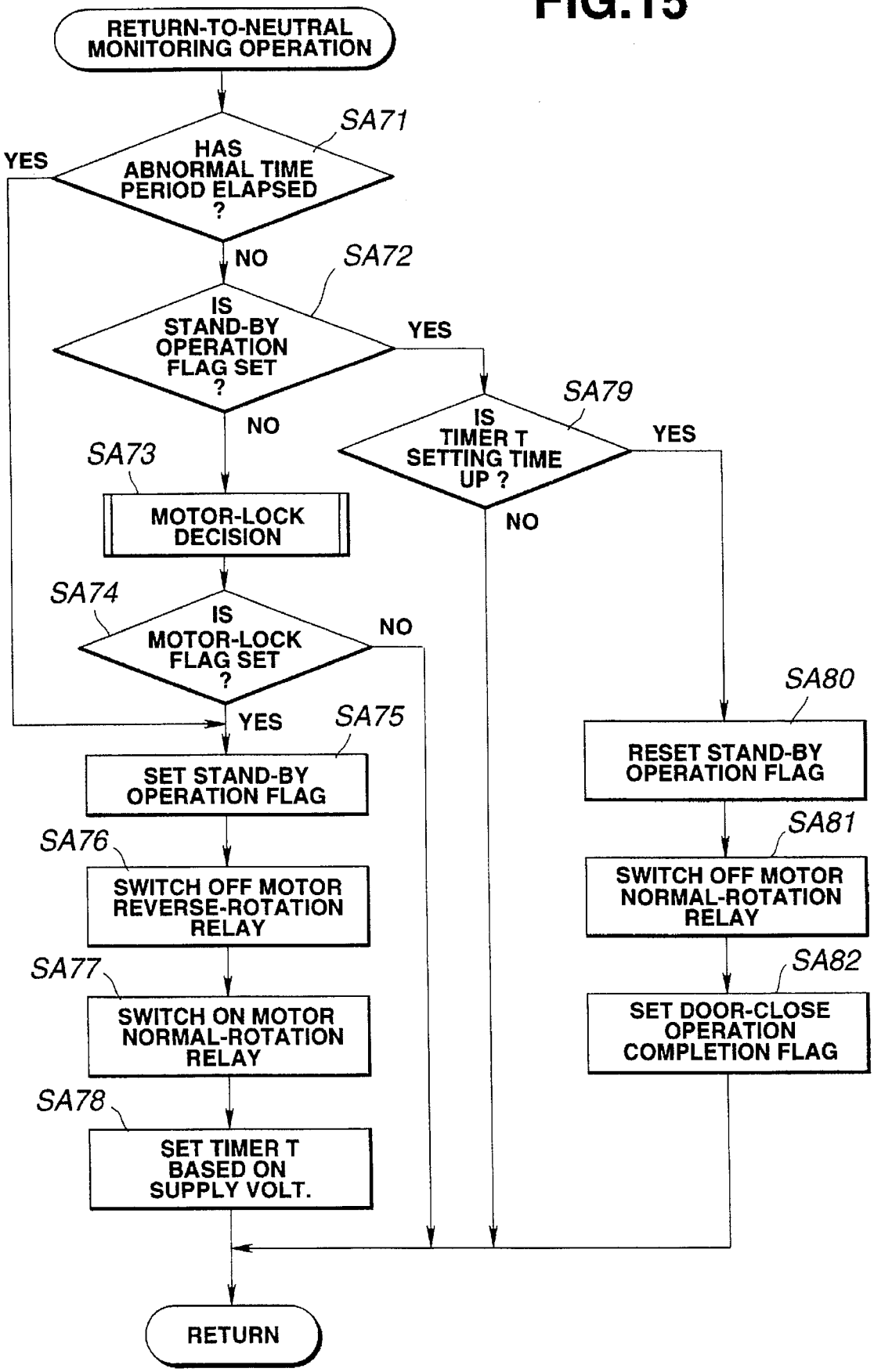
FIG. 15 is a flow chart explaining the return-to-neutral monitoring operation of the system of the second embodiment.

Referring to FIGS. 13 through 15, there is shown the second embodiment of the door closing system. The basic construction of the system of the second embodiment as shown in FIGS. 13 to 15 is similar to that of the first embodiment as shown in FIGS. 1 to 14. Therefore, the same reference numerals and step numbers used in the first embodiment will be applied to the corresponding elements and steps used in the second embodiment, for the purpose of comparison between the first and second embodiments. As previously discussed in the first embodiment, the system of the first embodiment is so designed that when the close lever 21 has returned to the stand-by position, the sector gear 24 is brought into strong-contact with the inner wall of the bracket 27, and then maintained in strong-contact with the inner wall of the bracket 27 even during de-activation of the door closing device 20. In such a case, a mechanical load applied to the driving mechanism for the close lever 21 is maintained at a high level as long as the latch member 12 is held at its fully-latched position. The principal object of the system of the second embodiment is to effectively reduce undesired high load applied to the driving mechanism for the close lever 21. In order to accomplish the above-noted object, in the system of the second embodiment, the door-close start operation shown in FIG. 9 (the first embodiment) is replaced with the door-close start operation shown in FIG. 14, while the return-to-neutral monitoring operation shown in FIG. 11 (the first embodiment) is replaced with the return-to-neutral monitoring operation shown in FIG. 15. As regards the door-close monitoring operation and the motor-lock decision operation, the system of the second embodiment is identical to that of the first embodiment.

As will be herebelow discussed in greater detail with respect to the door-close start operation of FIG. 14, the motor reverse-rotation flag F5 is effectively utilized to hold the close lever 21 at another stand-by position slightly offset from the previously-explained stand-by position obtained by the return-to-neutral monitoring operation of the system of the first embodiment, thus avoiding the above-noted undesiredly great load imparted to the driving mechanism for the close lever 21. The previously-explained stand-by position obtained by the return-to-neutral monitoring operation of the system of the first embodiment will be hereinafter referred to as a "first stand-by position" at which the sector gear 24 is in strong-contact with the inner wall of the bracket 27, while the other stand-by position obtained by the return-to-neutral monitoring operation of the system of the second embodiment will be hereinafter referred to as a "second stand-by position" at which the sector gear 24 is out of contact with the inner wall of the bracket 27 to provide a slight clearance therebetween.

In step SA11, a test is made to determine whether the motor reverse-rotation flag F5 is set. When the answer to step SA11 is negative, i.e., the flag F5 is reset, step SA12 enters in which a test is made to determine whether the half-latch detection switch 29 is switched ON. When the half-latch detection switch 29 is switched ON, the procedure flows to step SA13 in which the motor reverse-rotation relay is switched ON, and further to step SA14 in which the motor reverse-rotation flag F5 is set. With the reverse-rotation relay switched ON, the drive circuit for reverse-rotation of the motor 26 is established to initiate reverse-rotation of the motor. Thus, at the beginning of the door-close operation, the close lever 21 rotates in the direction indicated by the arrow B2 by way of the reverse-rotation of the motor. After the motor reverse-rotation flag F5 is set, the procedure advances from step SA11 to step SA15 in which the motor-lock decision as previously discussed with respect to FIG. 12 is made. In the motor-lock decision operation executed during the reverse-rotation of the motor 26, the controller monitors changes in the drive current I supplied to the motor 26 so as to determine whether the reverse rotation of the motor has been restricted, in other words, whether the close lever 21 has been shifted from the first stand-by position to the second stand-by position. When the controller decides that the motor is locked by detecting a steep current-rise, the motor-lock flag F4 is set via the motor-lock decision. In step SA16, a test is made to determine whether the motor-lock flag is set. With the motor-lock flag set at "1", the procedure flows from step SA16 through steps SA18 and SA19 to SA20.

In step SA18, the motor reverse-rotation relay is switched ON.

In step SA19, the motor reverse-rotation flag F5 is reset.

In step SA20, the door-close operation flag F1 is set, and then the door-close operation is started in the same manner as the system of the first embodiment. In this manner, the close lever 21 is rotated from the second stand-by position to the first stand-by position in the rotational direction indicated by the arrow B2 by way of reverse-rotation of the motor at the beginning of the door-close start operation, and then rotated away from the first stand-by position in the rotational direction indicated by the arrow B1 by way of normal rotation of the motor at the end of the door-close start operation. That is, the same door-close operation as the first embodiment begins with a slight time lag resulting from reverse-rotational movement from the second stand-by position to the first stand-by position.

The return-to-neutral monitoring operation of the system of the second embodiment will be discussed below in accordance with the flow chart shown in FIG. 15.

In step SA71, a test is made to determine whether or not the above-noted predetermined abnormal time period has elapsed from the time when the motor reverse-rotation relay has been switched ON. The answer to step SA71 is negative (NO), i.e., when the abnormal time period has not yet elapsed, step SA72 proceeds in which a test is made to determine whether a stand-by operation flag Fs, as will be discussed in more detail below, is set. When the answer to step SA72 is negative (NO), in case that the stand-by operation flag Fs is reset, step SA73 proceeds in which the previously-explained sub-routine for the motor-lock decision is executed as illustrated in FIG. 12. On the other hand, when the answer to step SA71 is affirmative, i.e., in case that the predetermined abnormal time period has elapsed, the controller decides that abnormality in the return-to-neutral operation takes place, and then step SA75 enters in which the stand-by operation flag is set. Thereafter, the motor reverse-rotation relay is switched OFF at step SA76, the motor normal-rotation relay is switched ON at step SA77, and also a setting time of a timer T is set depending on the supply voltage at step SA78.

In the motor-lock decision in step SA73, the controller decides that the close lever 21 has been rotated and returned to the first stand-by position and thus the reverse-rotation of the motor 26 is restricted or locked, while monitoring changes in the drive current I flowing across the motor 26. Once after the motor-lock flag is set by the motor-lock decision, the stand-by operation flag Fs is set at step SA75, the motor reverse-rotation relay is switched OFF at step SA76, the motor normal-rotation relay is switched ON at step SA77, and then the setting time of the timer T is set at step SA78. As a result of this, the close lever 21 is rotated from the first stand-by position to the second stand-by position in the rotational direction indicated by the arrow B1 of FIG. 3 by way of the normal rotation of the motor. As can be appreciated, the timer T is provided to automatically de-activate the motor 26 immediately when the close lever 21 has been rotated to or near the second stand-by position by normal rotation of the motor at the end of the return-to-neutral operation. That is, during motor normal-rotation executed at the end of the return-to-neutral operation, the angular displacement of the close lever 21 in the direction indicted by the arrow B1 or the time duration of normal rotation of the motor is limited by the setting time of the timer T. As is generally known, the rotational speed of the output shaft of the motor varies depending on the supply voltage. The higher the supply voltage, the higher the rotational speed of the motor. In order to insure a predetermined spaced relationship between the first and second stand-by positions, the setting time of the timer T is set so that the setting time is hyperbolically reduced in accordance with an increase in the supply voltage of the car battery, as appreciated from the characteristic curve of FIG. 13. After the stand-by operation flag Fs has been set and the setting time of the timer T has been set through the flow of steps SA75 to SA78, the procedure flows from step SA72 to step SA79.

In step SA79, a test is made to determine whether the setting time of the timer T is up. When the answer to step SA79 is affirmative (YES), step SA80 enters in which the stand-by operation flag Fs is reset. Thereafter, the motor normal-rotation relay is witched OFF at step SA81, and then the door-close operation completion flag F3 is set at step SA82. In this manner, as soon as the supply-voltage dependent setting time of the timer T has elapsed, at the end of the return-to-neutral operation, the normal-rotation of the motor can be stopped at a timing when the close lever 21 has reached essentially the second stand-by position.

In consideration of such a load condition that a load imparted to the motor during auto door-close operation is remarkably greater than a load imparted to the motor during return-to-neutral operation, a motor-load threshold of the stand-by position detection section 58 may be set at a smaller value than that of the full-latch detection section 57, so as to optimize the detection sensitivity for changes in the motor load.

Furthermore, a foreign body or substance sandwiched between the vehicle body and the sliding door 1 may be easily detected by means of the respective detection sections 57 and 58 which can monitor or detect changes in load of the motor 26. That is, in the event that a foreign body was sandwiched between the vehicle body and the door, the motor load would excessively increase. In case of such an excessive increase in the motor load, it is possible to enhance safety by de-energizing the motor 26 at once or by driving the motor in its reverse-rotational direction. Accordingly, in addition to effects of the system of the first embodiment, the system of the second embodiment can reduce a mechanical load, which load would be applied to the driving mechanism with the close lever held at the stand-by position, at a minimum.

As will be appreciated from the above, in the system made according to the present invention, changes in the motor load are effectively utilized for detection for both the stand-by position and the full-latch detection, thus simplifying the structure of detection means required for determination of a proper timing of various operations of the system. This ensures a small-sized, inexpensive system.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A powered vehicle door closing system for producing an auto-closing action to automatically move a latch member from a half-latched position to a fully-latched position, said system comprising:

a reversible motor mechanically linked through a linkage, having a stand by position, to said latch member, for powering a final, low-displacement/high-force movement of a vehicle door;

first detection means for detecting that said latch member reaches said half-latched position to generate a first signal indicating that said half-latched position is reached;

second detection means for detecting that said latch member reaches said fully-latched position during normal rotation of said motor to generate a second signal indicating that said fully-latched position is reached;

third detection means for detecting that said linkage returns to said stand-by position during reverse rotation of said motor to generate a third signal indicating that said stand-by position is recovered;

control means responsive to said first signal for moving said latch member toward said fully-latched position by said normal rotation, and responsive to said second signal for moving said linkage toward said stand-by position by said reverse rotation, and responsive to said third signal for de-energizing said motor;

first prevention means for preventing said normal rotation when said fully-latched position is reached; and second prevention means for preventing said reverse rotation when said stand-by position is reached, wherein said second detection means includes a first load detection means for detecting changes in load imparted to said motor when said normal rotation is prevented by said first prevention means, and said third detection means includes a second load detection means for detecting changes in load imparted to said motor when said reverse rotation is prevented by said second prevention means.

2. A powered vehicle door closing system as claimed in claim 1, wherein said first load detection means comprises a first current detection means for detecting changes in a drive current applied to said motor during said normal rotation, and said second load detection means comprises a second current detection means for detecting changes in a drive current applied to said motor during said reverse rotation.

3. A powered vehicle door closing system as claimed in claim 2, wherein said first current detection means generates said second signal when said drive current exceeds a first predetermined threshold during said normal rotation, and said second current detection means generates said third signal when said drive current exceeds a second predetermined threshold during said reverse rotation, and said second predetermined threshold is set at a lower value than said first predetermined threshold.

4. A powered vehicle door closing system as claimed in claim 3, wherein said first current detection means generates said second signal when said drive current exceeds said first predetermined threshold for a predetermined period of time during said normal rotation, and said second current detection means generates said third signal when said drive current exceeds said second predetermined threshold for a predetermined period of time during said reverse rotation.

5. A powered vehicle door closing system as claimed in claim 3, which further comprises means for moving said linkage to an additional stand-by position offset from said stand-by position by a predetermined short distance by said normal rotation of said motor, when said second current detection means generates said third signal.

6. A powered vehicle door closing system as claimed in claim 5, which further comprises means for moving said linkage from said additional stand-by position to said stand-by position, when said first detection means generates said first signal.

7. A powered vehicle door closing system as claimed in claim 5, wherein said means for moving said linkage to said additional stand-by position, moves said linkage to said additional stand-by position by driving said motor in a direction of said normal rotation for a setting time based on a supply voltage applied to said motor.

8. A powered vehicle door closing system as claimed in claim 7, wherein said setting time is hyperbolically reduced in accordance with an increase in said supply voltage.

* * * * *